US007671284B2

(12) United States Patent
Nourry et al.

(10) Patent No.: US 7,671,284 B2
(45) Date of Patent: Mar. 2, 2010

(54) MULTIDIRECTIONAL ACTUATOR WITH VARIABLE RETURN FORCE

(75) Inventors: Jean-Francois Nourry, Crecy la Chapelle (FR); Gilles Salvaterra, Reuil en Brie (FR)

(73) Assignee: CoActive Technologies, Inc., Greenwich, CT (US)

( * ) Notice: Subject to any disclaimer, the term of this patent is extended or adjusted under 35 U.S.C. 154(b) by 1124 days.

(21) Appl. No.: 11/292,526

(22) Filed: Dec. 2, 2005

(65) Prior Publication Data

US 2006/0135257 A1 Jun. 22, 2006

(30) Foreign Application Priority Data

Dec. 7, 2004 (FR) ..... 04 52886

(51) Int. Cl.
*H01H 9/26* (2006.01)

(52) U.S. Cl. ..... 200/5 A; 200/6 A; 200/553; 345/167; 463/36

(58) Field of Classification Search ..... 200/553, 200/1 R, 5 R, 6 A; 345/161, 167, 168; 463/36, 463/37, 38

See application file for complete search history.

(56) References Cited

U.S. PATENT DOCUMENTS 4,459,578 A * 7/1984 Sava et al. ..... 338/128
6,525,280 B2 * 2/2003 Chan et al. ..... 200/6 A
6,946,606 B2 * 9/2005 Kitagawa ..... 200/4

FOREIGN PATENT DOCUMENTS

| | | |
|---|---|---|
| DE | 102 43 223 | 3/2004 |
| DE | 10 2004 035 078 | 3/2005 |
| EP | 1 396 869 | 3/2004 |

* cited by examiner

*Primary Examiner*—Kyung Lee
(74) *Attorney, Agent, or Firm*—Pepper Hamilton LLP

(57) ABSTRACT

The invention proposes a multidirectional actuator (18) comprising:

a bottom support (22) with a main vertical axis "A", a top actuation member (24) that is mounted so as to tilt relative to the bottom support (22) between a central rest position and several actuation positions that are distributed angularly about the vertical axis "A" of the support (22); and means (48, 60) of returning the actuation member (24) to its central rest position which exert on the actuation member (24) a return force, whose vertical component is not zero and is oriented upwards, at at least one bearing point "P" situated radially at a distance from the vertical axis "A" of the support (22), characterized in that the value of the vertical component of the return force varies according to the angular position of the actuation member (24) about the vertical axis "A" of the support (22).

15 Claims, 5 Drawing Sheets

MULTIDIRECTIONAL ACTUATOR WITH VARIABLE RETURN FORCE

CROSS-REFERENCE

Applicant claims priority from French patent application S.N. 0452886 filed Dec. 7, 2004.

BACKGROUND OF THE INVENTION

The invention proposes a multidirectional actuator that comprises a tilting actuation member and means for producing a force for returning the actuation member.

There are numerous devices called joysticks that are used in various applications such as gaming joysticks or joysticks for one or more accessories of a motor vehicle, such as for example an agricultural machine or a worksite machine.

Such a joystick is usually mounted so as to articulate relative to a fixed support, and the user grasps the joystick with the hand to make it pivot and/or tilt relative to its support.

However, merely the pivoting and/or tilting movements of the joystick relative to its support may prove insufficient to control an accessory of an agricultural machine.

That is why it has been proposed to add a certain number of actuators to the joystick.

The joystick then supports for example buttons each of which makes it possible to control an additional function of the accessory of the agricultural machine and it supports actuators of the multidirectional type.

It is in particular desirable that the user is able to manipulate such a multidirectional actuator with a single finger, for example his thumb, the actuator being installed on a main front face of the joystick.

Document U.S. Pat. No. 6,266,046 describes such a multidirectional actuator that comprises a bottom support attached to the structure of the joystick and an actuation member that is mounted so as to tilt relative to the support towards several actuation positions.

Each of the actuation positions of the actuation member relative to the support is characterized by the angle of inclination of the main axis of the actuation member relative to the vertical axis of the support, and by the angular position of the actuation member about the vertical axis of the support.

The actuator comprises means of measuring the value of the angle of inclination of the main axis of the actuation member relative to the vertical axis of the support, and of measuring the angular position of the actuation member about the vertical axis of the support.

The measurement means are connected to an electronic device that is capable of determining the actuation position of the actuation member according to the angle of inclination of the main axis of the actuation member, and according to the angular position of the actuation member about the vertical axis of the support that have been measured.

According to this document, the measurement means comprise a movable magnet that is attached to the actuation member, and Hall effect sensors that are attached to the support.

The actuator also comprises means of returning the actuation member to a central rest position.

When the user manipulates the joystick or the actuator to control the accessory of the machine, he mostly looks at the accessory and he only rarely looks at the joystick and the actuator.

Thus, the user perceives the actuation position of the actuation member relative to the support essentially by the sensations produced by the force returning the actuation member to its rest position.

The return force is produced by an elastic element, here a spring, that is mounted compressed between the support and an intermediate button, so that the greater the angle of inclination of the actuation member relative to the support, the more the spring is compressed and consequently the greater the return force.

However, the return force does not vary according to the angular position of the actuation member about the vertical axis of the support.

Thus, for example when the user simultaneously inclines the joystick and the actuation member, he does not correctly perceive the angular position of the actuation member relative to the joystick.

SUMMARY OF THE INVENTION

The object of the invention is to propose a multidirectional actuator that allows the user to feel what the angular position of the actuation member is relative to the support.

With this objective, the invention proposes a multidirectional actuator of the type previously described, characterized in that the value of the vertical component of the return force varies according to the angular position of the actuation member about the vertical axis "A" of the support.

The invention proposes more particularly a multidirectional actuator comprising:

- a bottom support with a main, vertical axis "A" of symmetry,
- a top actuation member that is mounted so as to tilt relative to the bottom support between a central rest position in which the main axis "B" of the actuation member is generally coaxial with the vertical axis "A" of the support, and several actuation positions that are distributed angularly about the vertical axis "A" of the support and in each of which the main axis "B" of the actuation member is inclined relative to the vertical axis "A" of the support; and
- means of returning the actuation member to its central rest position which exert on the actuation member a return force, whose vertical component is not zero and is oriented upwards, at at least one bearing point "P" situated radially at a distance from the vertical axis "A" of the support.

According to other features of the invention:

- the return means comprise a button that is mounted so as to slide vertically relative to the support, the value of the vertical component of the return force is determined according to the vertical position of the button relative to the support, and the button is capable of interacting with the actuation member so that the vertical position of the button relative to the support varies according to the angular position of the actuation member about the vertical axis "A" of the support;
- the button comprises a top face that bears vertically upwards against a bearing face opposite the actuation member, and the top face of the button and the bearing face of the actuation member are formed so that the vertical dimension of the button relative to the support varies according to the angular position of the actuation member about the vertical axis "A" of the support;
- the value of the vertical component of the return force varies according to the angle of inclination of the axis "B" of the actuation member relative to the vertical axis "A" of the support;
- the top face of the button and the bearing face of the actuation member are formed so that the vertical position of the button relative to the support varies according to the angle of inclination of the axis "B" of the actuation member relative to the vertical axis "A" of the support;

the bearing face of the actuation member is of generally convex shape domed downwards and is generally coaxial with the axis "B" of the actuation member, and the bearing face of the actuation member comprises at least one groove that extends radially relative to the main axis "B" of the actuation member;

the bearing face of the actuation member comprises several grooves that are distributed angularly in an even manner about the main axis "B" of the actuation member;

the bearing face of the actuation member comprises four grooves that are distributed angularly at 90 degrees about the main axis "B" of the actuation member;

the top face of the button is generally flat and perpendicular to the vertical axis "A" of the support;

the actuator comprises a cradle for the articulation of the actuation member relative to the support, that is mounted so as to pivot relative to the support about a first pivoting axis, and relative to which the actuation member is mounted so as to articulate about a second pivoting axis;

the first pivoting axis of the cradle relative to the support is horizontal and concurrent with the vertical axis "A" of the support;

the second pivoting axis of the actuation member relative to the cradle is perpendicular to the first pivoting axis and is perpendicular to the main axis "B" of the actuation member;

each groove of the bearing face of the actuation member extends radially relative to the main axis "B" of the actuation member generally parallel to the first pivoting axis or parallel to the second pivoting axis, respectively;

the actuator comprises means of detecting by Hall effect the angular position of the actuation member about the main axis "A" of the support and of the angle of inclination of the main axis "B" of the actuation member relative to the vertical axis "A" of the support;

the actuation member supports a magnet arranged generally coaxially with the main axis "B" of the actuation member and the support supports an electronic circuit board which supports electronic components that are capable of producing an electric signal that can vary according to the variations of the magnetic field produced by the magnet when it is moved relative to the support.

Other features and advantages of the invention will appear on reading the following detailed description for the understanding of which reference should be made to the appended figures.

DESCRIPTION OF THE PREFERRED EMBODIMENTS

The description of the invention will adopt in a non-limiting manner the vertical, longitudinal and transverse orientations according to the V, L, T marking and the V1, L1, T1 marking indicated in the figures.

In the following description, identical, similar or equivalent elements will be indicated by the same reference numbers.

Figure 1:
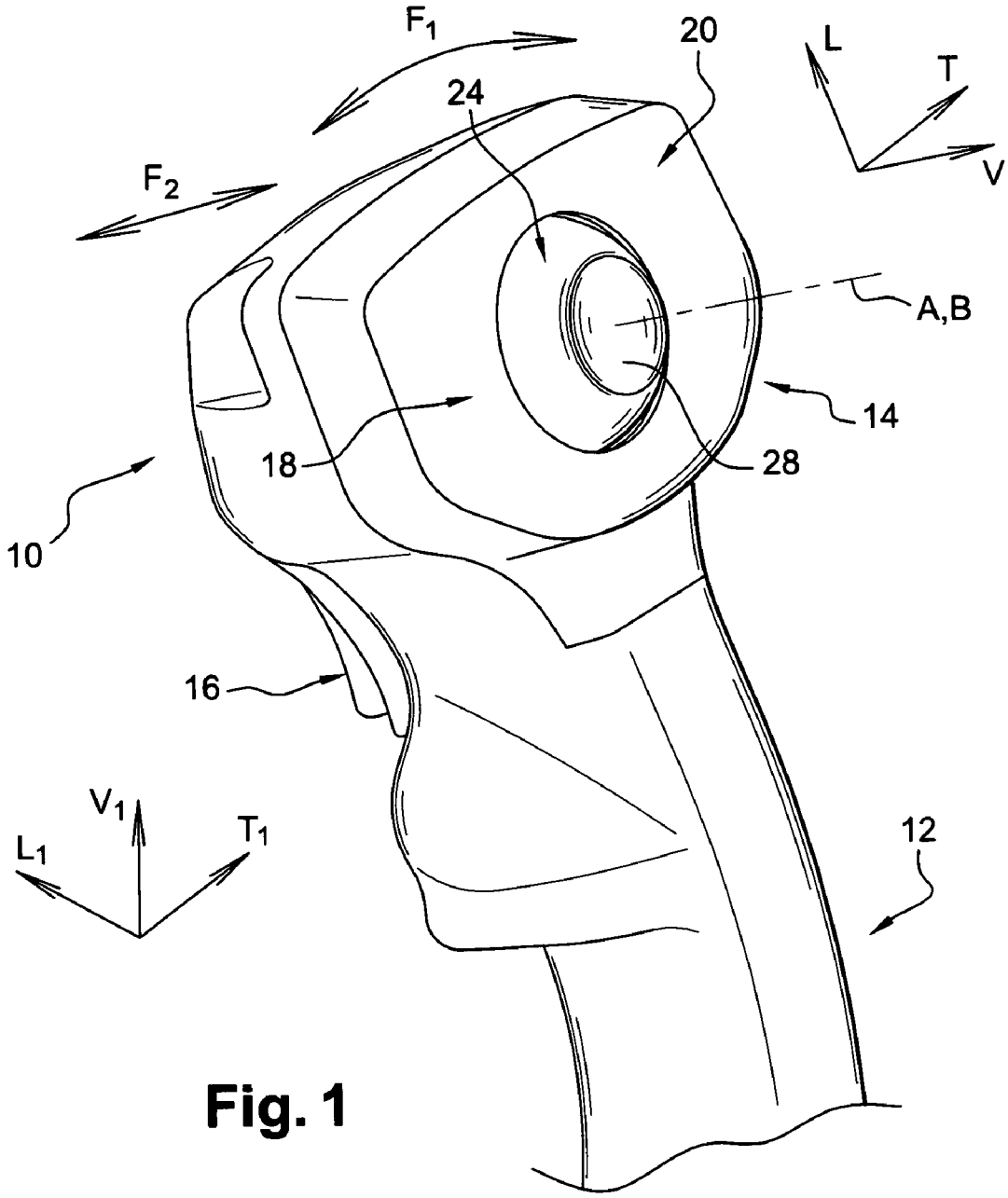
FIG. 1 is a schematic representation in perspective of a joystick that supports a multidirectional actuator according to the invention.

FIG. 1 shows a joystick 10 that allows a user to control a device (not shown), for example an accessory of an agricultural machine, by using only one of his hands.

The joystick 10 comprises a central gripping section 12 that extends generally vertically in the direction V1 and by means of which the user grasps the joystick 10 to manipulate it, a bottom section (not shown) of articulation of the joystick 10 relative to a fixed element (not shown), and a top head 14 which supports the additional control actuators of the device.

The articulation of the bottom section of the joystick 10 relative to the fixed element is of a known type, and it is made so that the joystick 10 is capable of pivoting and/or tilting about a central articulation point.

Thus, it is possible to make the joystick 10 tilt longitudinally from front to rear, and/or transversely from right to left relative to the rest position represented in FIG. 1, in the longitudinal direction L1 and transverse direction T1, as has been shown by the arrows F1, F2 and it is possible to cause the joystick 10 to pivot about the rest position.

The top head 14 of the joystick supports a first actuator 16 that consists of a button arranged on the front part of the top head 14. This button 16 is formed so that the user can actuate it with his index finger, like the trigger of a firearm.

The top head 14 supports a second actuator 18 of the multidirectional type that is arranged through a rear transverse wall 20 of the top head 14 and which is intended to be manipulated by the thumb of the user.

In the following description of the multidirectional actuator 18, use will be made in a nonlimiting manner of the vertical, longitudinal and transverse orientations according to the V, L, T marking indicated in FIGS. 2 to 7.

The term "actuator" will also be used to identify the multidirectional actuator 18 according to the invention.

As can be seen in FIGS. 2 to 7, the actuator 18 comprises a bottom support 22 by means of which the actuator 18 is mounted onto the joystick 10, and an actuation member 24 by means of which the user operates the actuator 18.

When the actuator 18 is mounted on the joystick 10, the support 22 is situated vertically below the rear wall 20 of the joystick 10, so that it is hidden inside the head 14 of the joystick 10.

The support 22 comprises a bottom 36 in the form of a flat plate that is horizontal and has a main axis A of symmetry whose main orientation is vertical, by means of which the support 22 is attached to the joystick 10.

The actuation member 24 protrudes partly upwards relative to the top wall 20 and it traverses accordingly an orifice 26 of the top wall 20.

The actuation member 24 has a shape that is generally domed upwards; its main axis B of symmetry is coaxial with the vertical axis A of the support 22.

Here, the actuation member 24 forms a spherical dome and its top part 24*s* comprises a circular-shaped recess 28, coaxial with the main axis B of the actuation member 24.

The recess 28 receives the thumb of the user, so that it limits the risk of the thumb sliding relative to the top face of the actuation member 24.

Figure 2:
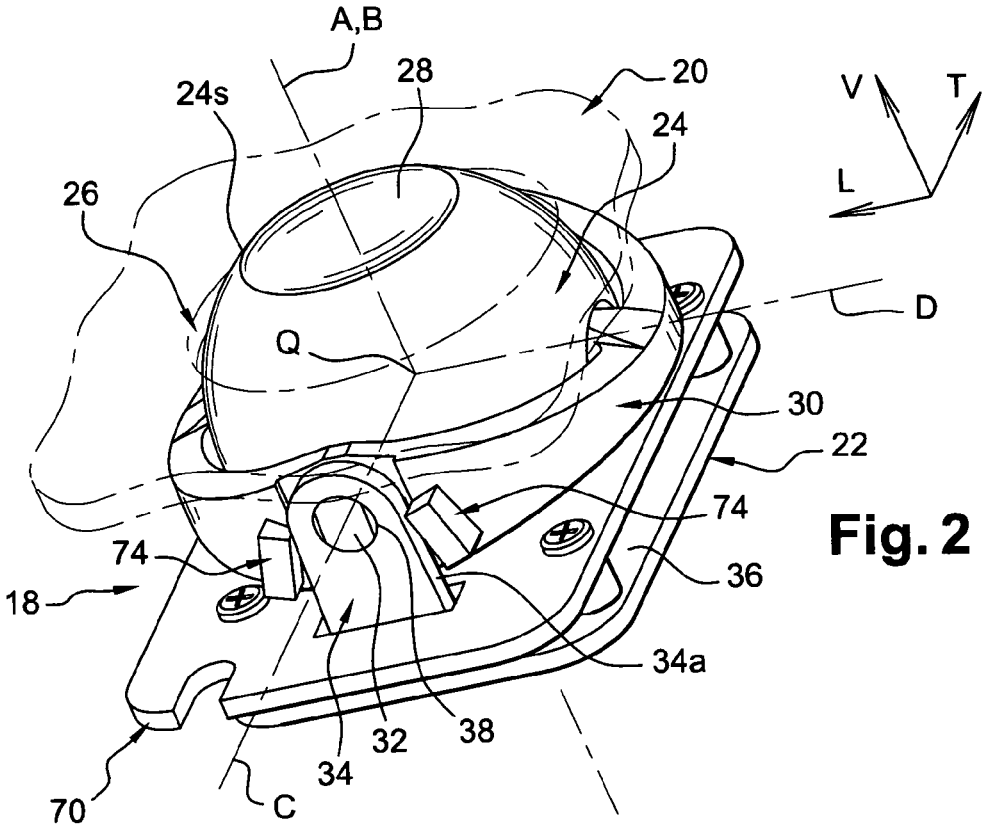
FIG. 2 is a detail in larger scale of the actuator represented in FIG. 1.

The actuation member 24 is mounted so as to tilt relative to the bottom support 22 by means of an intermediate cradle 30, between a central rest position represented in FIG. 2, and tilted actuation positions distributed angularly about the vertical axis A of the support 22.

When the actuation member 24 is in its rest position, its main axis B is generally coaxial with the vertical axis A of the support 22.

Figure 4:
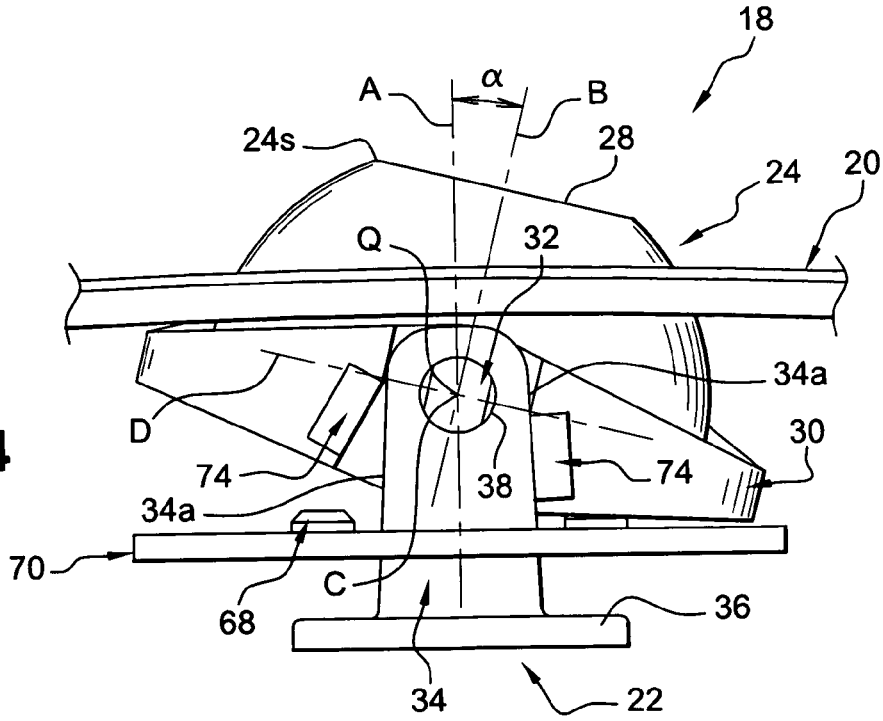
FIG. 4 is a side view of the actuator represented in FIG. 2, in which the actuator has pivoted relative to the support about the transverse pivoting axis.

When the actuation member 24 is in a tilted actuation position, as can be seen for example in FIG. 4, its main axis B is inclined relative to the vertical axis A of the support 22 at an acute angle "a" called the angle of inclination or the angle of tilt.

A top part of the main axis B of the actuation member 24 is defined by the top semi-axis of the main axis B delimited by the point at which the main axis B of the actuation member 24 intersects the vertical axis A of the support 22, which extends in a radial semi-plane relative to the vertical axis A of the support 22.

The angular position of the top part of the main axis B relative to the vertical axis A of the support 22 corresponds to the angular position of the actuation member 24 about the vertical axis of the support 22.

The actuator 18 also comprises means for returning the actuation member 24 to its rest position as soon as the user relaxes his pressure on the actuation member 24.

These return means comprise a button 48 that is mounted so as to slide relative to the support 22, coaxially with the vertical axis A of the support 22, and that bears vertically upwards on a bearing face 50 of the actuation member 24 to achieve the return of the actuation member 24.

The button 48 comprises a head 52 for bearing against the bearing face 50 of the actuation member, and a bottom body 54 in the shape of a cylindrical rod coaxial with the vertical axis A of the support 22.

The bearing head 52 has a circular shape of revolution, it is coaxial with the vertical axis A of the support 22, and it comprises an annular top face 52*s* which bears on the bearing face 50 of the actuation member 24 at at least one point P of contact (FIG. 6) situated radially at a distance from the vertical axis A of the support 22.

The bottom body 54 of the button 48 is received in a complementary cylindrical housing 56 made in a cylindrical barrel 58 of the support 22 that extends vertically upwards from the bottom 36 of the support 22, so that the button 48 is mounted so as to slide axially along the vertical axis A relative to the support 22.

Finally, the return means comprise an elastic element 60 which here consists of a helical or coil spring, that is mounted compressed between the bearing head 52 of the button and the bottom 36 of the support 22.

The spring 60 permanently exerts a return force oriented upwards on the button 48 and the button 48 transmits this return force to the actuation member 24 at the point of contact P.

The spring is mounted compressed between the bearing head 52 of the button 48 and the bottom 36 of the support 22 and a vertical movement downwards of the button 48 relative to the support 22 causes a greater compression of the spring 60 and consequently the amplitude of the return force increases.

Conversely, a vertical upwards movement of the button 48 relative to the support 22 reduces the compression of the spring 60 and consequently the amplitude of the return force decreases.

Figure 6:
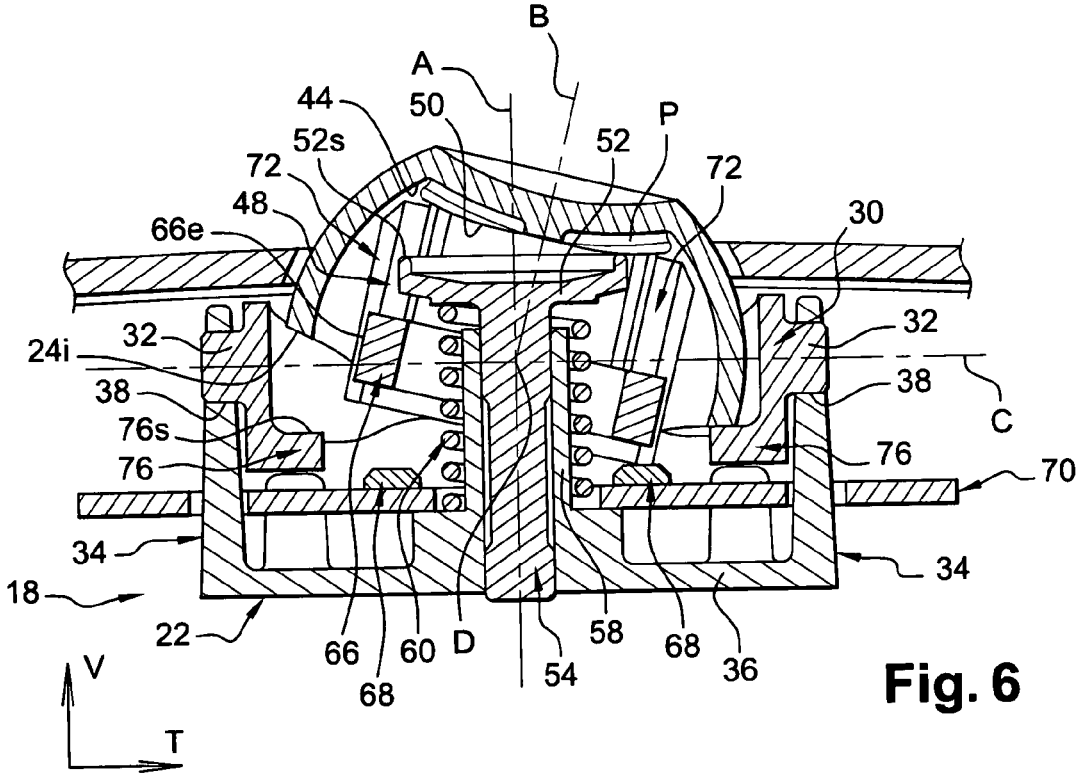
FIG. 6 is a section similar to that of FIG. 5, in which the actuation member pivoted relative to the support about the longitudinal pivoting axis.

The bearing face 50 of the actuation member 24 and the top face 52*s* of the bearing head 52 are formed so that, when the user acts on the actuation member 24 to make it tilt to an angular actuation position, as can be seen for example in FIG. 6, the button 48 is made to slide downwards relative to the support 22.

The bearing face 50 of the actuation member 24 and the top face 52*s* of the bearing head 52 are also shaped so that the higher the value of the acute angle of inclination "a", the lower the vertical position of the button 48 relative to the support 22, and therefore the higher the value of the return force.

Figure 7:
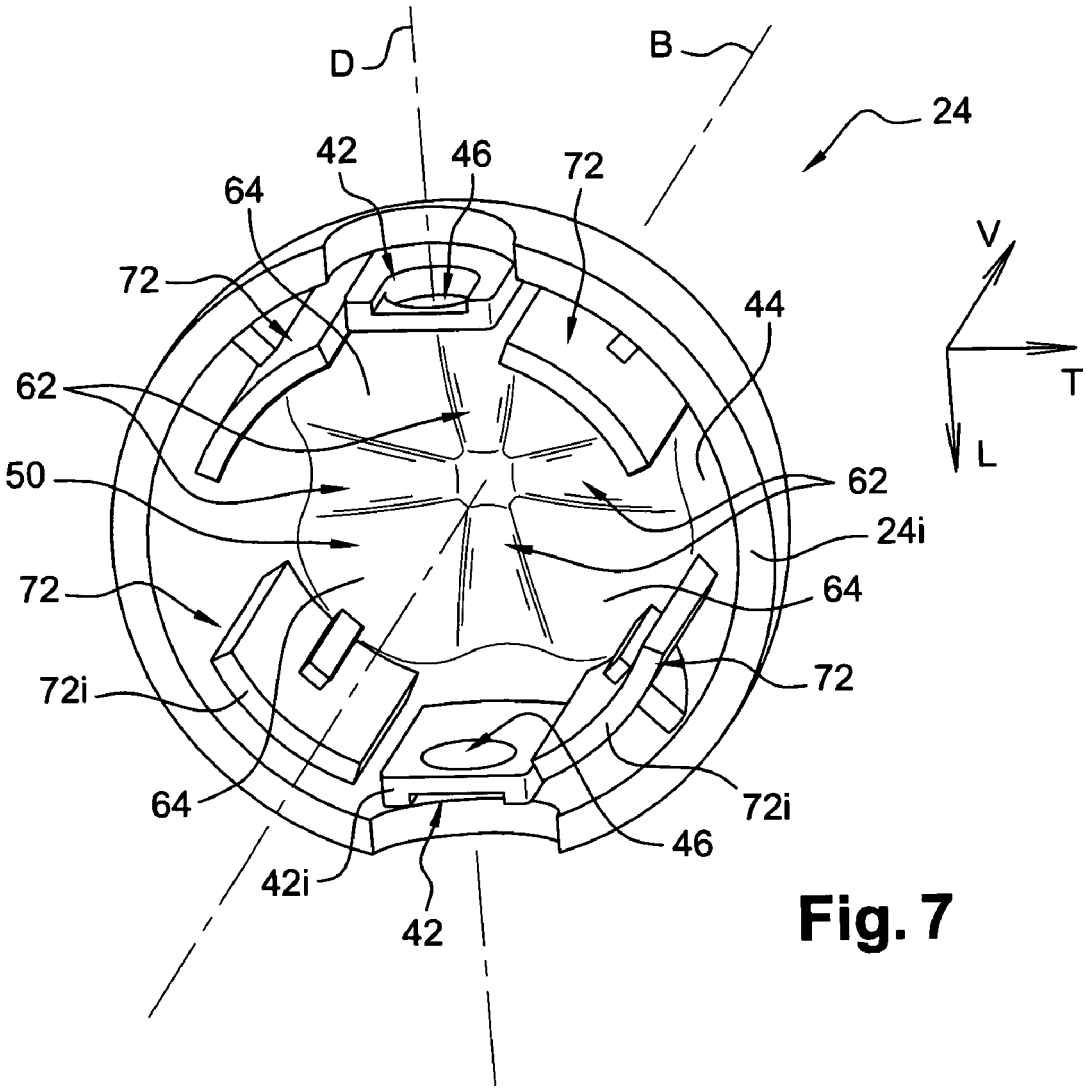
FIG. 7 is a schematic representation in perspective from below of the actuation member according to the invention, showing the radial grooves of the bearing face of the actuation member.

For this, as can be seen in FIG. 7, the bearing face 50 of the actuation member is convex, domed downwards, and is coaxial with the main axis B of the actuation member 24.

As has been said above, the return force produced by the spring 60 is transmitted by the button 48 to the actuation member 24, and the actuation member 24 transmits the return force to the finger of the user.

The user then feels a resistance to the movement of the actuation member 24 which increases gradually as the actuation member 24 is inclined relative to its central rest position.

According to the invention, the return means are formed so that the amplitude of the return force exerted on the actuation member 24 varies according to the angular position of the actuation member 24 about the vertical axis A of the support 22.

Accordingly, and according to the invention, the bearing face 50 of the actuation member 24 and the top face 52*s* of the bearing head 52 are shaped so that the vertical position of the button relative to the support varies according to the angular position of the actuation member 24 about the vertical axis A of the support 22.

According to the invention, the bearing face 50 of the actuation member 24 and the top face 52*s* of the bearing head 52 are formed so that, for certain predefined angular positions of the actuation member 24 about the vertical axis A of the support, which each define a predefined actuation position of the actuation member 24 relative to the support 22, the value of the return force is less than the value of the return force when the actuation member 24 is in another angular position.

Thus, for a given value of the angle of inclination "a", the user feels a weaker resistance to the movement when he acts on the actuation member 24 to make it pivot towards one of the predefined angular positions that is associated with this angle of inclination "a", than when he acts on the actuation member 24 to make it pivot towards another angular position.

According to a preferred embodiment of the invention, the predefined actuation positions of the actuation member 24 are distributed about the vertical axis A so that they form one or more radial alignments of actuation positions of the actuation member 24 relative to the main axis A.

Here, the bearing face 50 of the actuation member 24 and the top face 52*s* of the bearing head 52 are formed so that, for four predefined angular positions of the actuation member 24 about the vertical axis A of the support, the value of the return force is less than the value of the return force when the actuation member 24 is in another angular position.

Thus, the predefined actuation positions of the actuation member 24 form four radial alignments that are distributed angularly regularly at 90 degrees about the vertical axis A, and that are parallel to the main longitudinal direction L or to the main transverse direction T.

According to the invention, the bearing face 50 of the actuation member 24 comprises a groove 62 that is associated with each of the radial alignments of the predefined actuation positions, which extends in a radial semi-plane relative to the main axis B of the actuation member 24 and whose angular position of the groove 62 about the vertical axis A is identical to the angular position of the associated radial alignment.

Thus, as can be seen in FIG. 7, the bearing face 50 of the actuation member 24 comprises four grooves 62 that are distributed angularly at 90 degrees about the main axis B of the actuation member 24, so that each groove 62 extends radially longitudinally or transversely relative to the main axis B.

The bearing face 50 of the actuation member 24 thus consists of an alternation of grooves 62 and of bosses (or ribs) 64, distributed about the main axis B of the actuation member.

Finally, the top face 52*s* of the bearing head 52 of the button 48, which interacts with the bearing face 50 of the actuation member 24, has a horizontal annular shape centered on the vertical axis A, and it is flat.

Thus, when the user acts on the actuation member 24 to make it pivot relative to the support 22 towards one of the predefined actuation positions, the top face 52*s* of the bearing head 52 of the button 48 bears on the edges of the groove 62 associated with the actuation position.

On the other hand, when the user acts on the actuation member 24 to make it pivot relative to the support 22 towards any actuation position, that is not one of the predefined actuation positions, the top face 52*s* of the bearing head 52 of the button 48 bears on a boss 64 associated with the bearing face 50.

The edges of the grooves 62 are situated vertically above the bosses 64. The result of this is that, for the same value of the angle of inclination "α" of the actuation member 24 relative to the support 22, the vertical dimension of the button 48 relative to the support is greater when the top face 52*s* of the head 52 of the button 48 is bearing on the edges of a groove 62 than when the top face 52*s* of the head 52 of the button 48 is bearing on a boss 64.

The result of this is that, for a given value of the angle of inclination "α" when the user acts on the actuation member 24 to make it pivot towards a predefined actuation position, the return force produced by the spring 60 is weaker than when the user acts on the actuation member 24 to make it pivot towards any actuation position.

To allow the tilting of the actuation member 24 relative to the support 22, the intermediate cradle 30 is mounted so as to pivot relative to the support 22 about a first transverse pivoting axis C that is concurrent with the vertical axis A of the support 22, and the actuation member 24 is mounted so as to pivot relative to the intermediate cradle 30 about a second pivoting axis D that is perpendicular to and concurrent with the first pivoting axis C, and with the main axis B of the actuation member 24.

Thus, the intermediate cradle 30 articulates the actuation member 24 relative to the support 22 in the manner of a universal joint.

According to a preferred embodiment of the intermediate cradle 30, the first and second pivoting axes C and D are concurrent with the vertical axis A of the support 22 at a single point or center Q (FIG. 2) that is fixed relative to the support 22.

Thus, the actuation member 24 rotates about this fixed center Q when it is moved towards any one of its actuation positions.

The intermediate cradle 30 is of generally annular shape and is coaxial with the vertical axis A of the support 22 and the intermediate cradle 30 extends radially about the bottom edge 24*i* of the actuation member 24.

For its articulation relative to the support 22, the intermediate cradle 30 comprises two outer fingers 32 which extend radially towards the outside of the cradle 30, relative to the vertical axis A of the support, and which are coaxial with the first pivoting axis C.

The support 22 comprises two lugs 34 which extend vertically upwards from the bottom 36 and which are distributed transversely either side of the cradle 30.

Each of these lugs 34 is associated with an outer finger 32 and its free top end 34*s* comprises a circular hole 38 coaxial with the first pivoting axis C, in which the associated outer finger 32 is received rotatably.

The actuation member 24 is articulated relative to the cradle 30 by means of two inner fingers 40 which extend radially relative to the vertical axis A towards the inside of the cradle 30, and which are coaxial with the second pivoting axis D.

The actuation member 24 comprises two inner lugs 42 represented in FIG. 7, each lug 42 of which is associated with an inner finger 40 of the cradle and extends vertically downwards from the bottom 44 of the actuation member 24.

The free bottom end 42*i* of each lug 42 comprises a circular hole 46 coaxial with the second pivoting axis D, in which the associated inner finger 40 is received rotatably.

According to a preferred embodiment of the invention, the first pivoting axis C and the second pivoting axis D are oriented relative to the support 22 and relative to the actuation member 24 so that each is parallel with two grooves 64 of the bearing face 50 of the actuation member 24, which are symmetrical relative to the main axis B of the actuation member.

Thus, for example, and as has been shown in the figures, the first pivoting axis C is parallel with the transverse direction "T" and the second pivoting axis D is parallel with the longitudinal direction "L".

However, it will be understood that the invention is not limited to this embodiment and that the first pivoting axis C and the second pivoting axis D may be offset angularly about the vertical axis A, relative to the longitudinal direction "L" and the transverse direction "T".

Finally, and according to another aspect of the invention, the intermediate cradle 30 comprises abutment means making it possible to limit the angle of inclination "a" of the actuation member 24 relative to the support 22.

Figure 3:
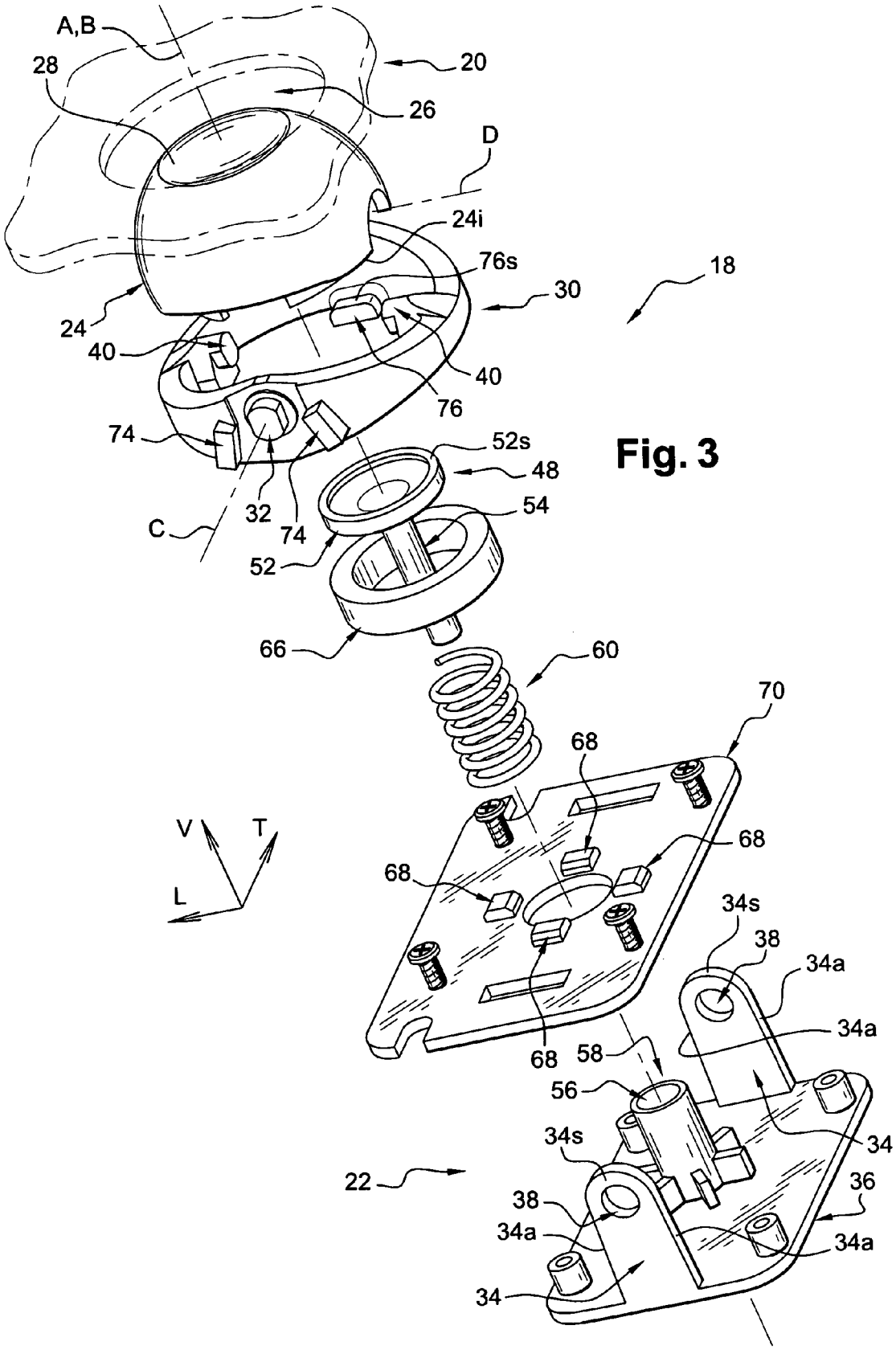
FIG. 3 is an exploded schematic representation of the actuator represented in FIG. 2.

As can be seen in FIGS. 2 to 4, the intermediate cradle 30 comprises first abutments 74 of the intermediate cradle 30 pivoting about the first pivoting axis C which extend radially towards the outside of the intermediate cradle 30 from its outer cylindrical wall 30*e* and which are arranged either side of each outer finger 32 and either side of the vertical lug 34 associated with the outer finger.

Thus, each first abutment 74 is capable of butting against the vertical edge 34*a* opposite the associated vertical lug 34 when the intermediate cradle 30 pivots relative to the support 22, as has been shown in FIG. 4.

Figure 5:
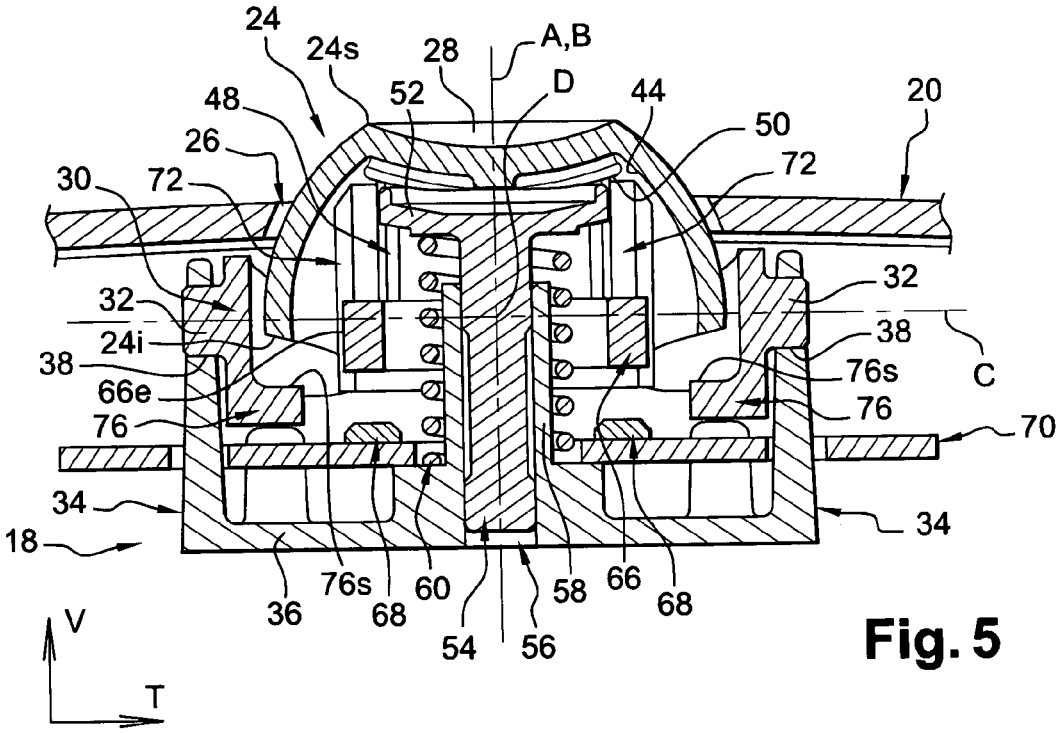
FIG. 5 is a section along a vertical transverse axial plane of the actuator represented in FIG. 2.

The tilt of the actuation member 24 relative to the intermediate cradle 30, about the second pivoting axis D, is limited by means of second abutments 76 represented in particular in FIGS. 5 and 6.

Each of these second abutments 76 extends radially relative to the vertical axis A of the support 22, parallel to the first pivoting axis C, and towards the inside of the intermediate cradle 30.

Thus, when the actuation member 24 pivots relative to the intermediate cradle 30, its bottom edge 24*i* comes to butt against the top face 76*s* of the second abutment 76 opposite.

The actuator 18 according to the invention comprises means for detecting each actuation position towards which the actuation member 24 has pivoted under the action of the user. These detection means thus make it possible to determine the value of the angle of inclination "a" of the main axis B of the actuation member relative to the vertical axis A of the support 22, and the angular position of the actuation member 24 about the vertical axis A.

According to the invention, the detection means operate on the Hall effect principle, and they comprise for this purpose a movable magnetic element 66 and fixed complementary magnetic elements 68 that are mounted on an electronic component-bearing circuit board 70.

The movable magnetic element 66 here consists of a magnet that is of annular shape, coaxial with the main axis B of the actuation member and which is attached to the actuation member 24.

The actuation member 24 comprises four fastening lugs 72 which extend vertically downwards from the bottom 44 of the actuation member 24 and whose free bottom end 72*i* of each attachment lug 72 presses against the outer cylindrical face 66*e* of the magnet 66 to attach the magnet 66 to the actuation member 24.

Thus, the magnet 66 is fixedly attached to the actuation member 24 while tilting relative to the support 22.

Each of the fixed magnetic elements 68 consists of a Hall effect magnetic sensor, which produces an electric signal that can vary according to the amplitude of the magnetic field produced by the magnet 66 at this fixed sensor 68.

The detection means here comprise four fixed sensors 68 which are distributed angularly at 90 degrees about the vertical axis A of the support 22 and which are arranged radially at right angles to the magnet 66.

When the user acts on the actuation member 24, the magnet 66 moves relative to the fixed sensors 68, so that the magnetic field produced by the magnet 66 varies at each of the fixed sensors 68.

Each fixed sensor 68 produces an electronic signal representative of the magnetic field that it perceives, and this electronic signal is transmitted to an electronic control device (not shown), by means of the electronic component-bearing circuit board 70.

The electronic control device is formed so that it is capable of analyzing the electronic signals originating from the fixed sensors 68 to determine the corresponding movement of the magnet 66, and to deduce therefrom the angle of inclination "α" of the main axis B of the actuation member 24 and the angular position of the actuation member 24 about the vertical axis A of the support 22.

The actuator 18 according to the invention has been described as being mounted on a joystick 10.

However, it will be understood that the invention is not limited to this embodiment, and that the actuator may be mounted on any other device, particularly on a portable electronic device such as a game console.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A multidirectional actuator comprising: a bottom support with a main, vertical axis "A" of symmetry; a top actuation member that is mounted so as to tilt relative to the bottom support between a central rest position in which the main axis "B" of the actuation member is generally coaxial with the vertical axis "A" of the support, and several actuation positions that are distributed angularly about the vertical axis "A" of the support and in each of which the main axis "B" of the actuation member is inclined relative to the vertical axis "A" of the support; and means of returning the actuation member to its central rest position which exert on the actuation member a return force, whose vertical component is not zero and is oriented upwards, at least one bearing point "P" situated radially at a distance from the vertical axis "A" of the support, characterized in that the value of the vertical component of the return force varies according to the angular position of the actuation member about the vertical axis "A" of the support, wherein the return means comprise:

a button that is mounted so as to slide vertically relative to the support, and of the type in which the value of the vertical component of the return force is determined according to the vertical position of the button relative to the support, characterized in that the button is capable of interacting with the actuation member so that the vertical position of the button relative to the support varies according to the angular position of the actuation member about the vertical axis "A" of the support, wherein the button comprises:

a top face that bears vertically upwards against a bearing face opposite the actuation member, and in that the top face of the button and the bearing face of the actuation member are formed so that the vertical dimension of the button relative to the support varies according to the angular position of the actuation member about the vertical axis "A" of the support.

2. An actuator according to claim 1, characterized in that the value of the vertical component of the return force varies according to the angle of inclination ".alpha." of the axis "B" of the actuation member relative to the vertical axis "A" of the support.

3. An actuator according to claim 2, characterized in that the top face of the button and the bearing face of the actuation member are formed so that the vertical position of the button relative to the support varies according to the angle of inclination of the axis "B" of the actuation member relative to the vertical axis "A" of the support.

4. An actuator according to claim 1, characterized in that the bearing face of the actuation member is of generally convex shape domed downwards and is generally coaxial with the axis "B" of the actuation member, and in that the bearing face of the actuation member comprises at least one groove which extends radially relative to the main axis "B" of the actuation member.

5. An actuator according to claim 4, characterized in that the bearing face of the actuation member comprises several grooves that are distributed angularly in an even manner about the main axis "B" of the actuation member.

6. An actuator according to claim 5, characterized in that the bearing face of the actuation member comprises four grooves that are distributed angularly at 90 degrees about the main axis "B" of the actuation member.

7. An actuator according to claim 6, characterized in that the top face of the button is generally flat and perpendicular to the vertical axis "A" of the support.

8. An actuator according to claim 1, characterized in that the actuator comprises a cradle, for the articulation of the actuation member relative to the support, that is mounted so as to pivot relative to the support about a first pivoting axis "C", and relative to which the actuation member is mounted so as to articulate about a second pivoting axis "D".

9. An actuator according to claim 8, characterized in that the first pivoting axis "C" of the cradle relative to the support is horizontal and concurrent with the vertical axis "A" of the support.

10. An actuator according to claim 8, characterized in that the second pivoting axis "D" of the actuation member relative to the cradle is perpendicular to the first pivoting axis "C" and is perpendicular to the main axis "B" of the actuation member.

11. An actuator according to claim 8, characterized in that each groove of the bearing face of the actuation member extends radially relative to the main axis "B" of the actuation member generally parallel to the first pivoting axis "C" or parallel to the second pivoting axis "D", respectively.

12. An actuator according to claim 1, characterized in that it comprises means of detecting by Hall effect the angular position of the actuation member about the main axis "A" of the support and the angle of inclination of the main axis "B" of the actuation member relative to the vertical axis "A" of the support.

13. An actuator according to claim 1, characterized in that the actuation member supports a magnet arranged generally coaxially with the main axis "B" of the actuation member and in that the support supports an electronic circuit board which supports electronic components that are capable of producing an electric signal that can be varied according to the variations of the magnetic field produced by the magnet when it is moved relative to the support.

14. A multidirectional actuator comprising:

a bottom support with a main, vertical axis "A" of symmetry;

a top actuation member that is mounted so as to tilt relative to the bottom support between a central rest position in which the main axis "B" of the actuation member is generally coaxial with the vertical axis "A" of the support, and several actuation positions that are distributed angularly about the vertical axis "A" of the support and in each of which the main axis "B" of the actuation member is inclined relative to the vertical axis "A" of the support, wherein the bearing face of the actuation member is of generally convex shape domed downwards and is generally coaxial with the axis "B" of the actuation member, and in that the bearing face of the actuation member comprises at least one groove which extends radially relative to the main axis "B" of the actuation member; and return means configured to return the actuation member to its central rest position which exert on the actuation member a return force, whose vertical component is not zero and is oriented upwards, at least one bearing point "P" situated radially at a distance from the vertical axis "A" of the support, characterized in that the value of the vertical component of the return force varies according to the angular position of the actuation member about the vertical axis "A" of the support.

15. A multidirectional actuator comprising:

a bottom support with a main, vertical axis "A" of symmetry;

a top actuation member that is mounted so as to tilt relative to the bottom support between a central rest position in which the main axis "B" of the actuation member is generally coaxial with the vertical axis "A" of the support, and several actuation positions that are distributed angularly about the vertical axis "A" of the support and in each of which the main axis "B" of the actuation member is inclined relative to the vertical axis "A" of the support;

return means configured to return the actuation member to its central rest position which exert on the actuation member a return force, whose vertical component is not zero and is oriented upwards, at least one bearing point "P" situated radially at a distance from the vertical axis "A" of the support, characterized in that the value of the vertical component of the return force varies according to the angular position of the actuation member about the vertical axis "A" of the support; and a cradle for the articulation of the actuation member relative to the support, the cradle mounted so as to pivot relative to the support about a first pivoting axis "C", and relative to which the actuation member is mounted so as to articulate about a second pivoting axis "D".

* * * * *